United States Patent [19]

Austrins et al.

[11] 3,991,880

[45] Nov. 16, 1976

[54] PACKAGE FOR NON-ROUND BOTTLES

[75] Inventors: Andrievs Austrins; Daniel A. Leo, both of Dallas, Tex.

[73] Assignee: Anderson, Clayton & Co., Houston, Tex.

[22] Filed: Aug. 15, 1975

[21] Appl. No.: 605,114

[52] U.S. Cl. ..... 206/431; 206/432

[51] Int. Cl.[2] ..... B65D 85/30

[58] Field of Search ..... 206/431, 432, 433, 145, 206/147, 160, 180, 182, 183, 186; D9/143

[56] References Cited

UNITED STATES PATENTS

| | | | |
|---|---|---|---|
| 3,321,096 | 5/1967 | Hebel | 215/1 R |
| 3,387,702 | 6/1968 | Reynolds et al. | 206/432 X |
| 3,532,214 | 10/1970 | Helms | 206/193 |
| 3,746,160 | 7/1973 | Thompson et al. | 206/432 X |
| D79,336 | 9/1929 | Krank | D9/143 |

FOREIGN PATENTS OR APPLICATIONS

| | | | |
|---|---|---|---|
| 1,145,424 | 3/1969 | United Kingdom | 206/432 |

*Primary Examiner*—Leonard Summer
*Attorney, Agent, or Firm*—Fulbright & Jaworski

[57] ABSTRACT

A package for non-round bottles wherein the bottles are aligned in rows, each bottle having parallel flat surfaces on opposed sides to mate with like flat surfaces of other such bottles, a tray, a divider member between rows of the bottles and a film member enveloping and tightly holding the bottles, tray and divider together.

9 Claims, 4 Drawing Figures

PACKAGE FOR NON-ROUND BOTTLES

BACKGROUND OF THE DISCLOSURE

The packaging, shipping, crating and display of bottled food products have traditionally involved cumbersome and expensive procedures. Packaging material costs, breakage, pilferage, bulkiness and space-consumption, retail display and the like have presented problems to the manufacturing and retail trades. Most bottled products, for example, are normally packaged and shipped in corrugated fiberboard containers with full cell partitions between the bottles. Such containers provide protection for the bottles but are expensive, are laborious to open for removal of the products, are bulky and are vulnerable to pilferage which may go undetected because containers within a box are not visible unless the box is opened.

Some of the shortcomings of corrugated fiberboard boxes have been eliminated by reducing the amount of corrugated fiberboard used and overlaying containers therein with heat-shrunk, transparent (or opaque) film-like material. This packaging technique reduces storage and shipping space required, decreases the package weight and offers visibility of the product within a package. Heat-shrunk, film-like material has been used for the most part for metal cans, paperboard cartons, and round glass bottle packaging. It would be highly desirable to use a filmlike type package for non-round glass bottles if a workable package were developed, and the present invention is directed to such end.

While the Applicants are aware of numerous patents and packaging techniques that relate to the art, from among the patents known to Applicants, those deemed most pertinent to the subject matter of the present invention include U.S. Pat. Nos. Des. 6,489, Des. 21,390, Des. 38,430; 1,127,141; 1,155,972, Des. 92,426, Des. 175,858; 3,321,096; 3,347,365; 3,331,503; 3,532,214, Re. 27,212 and 3,746,160. The foregoing patents disclose various bottle configurations, fiberboard containers and heat-shrunk, film-like packages. However, none teaches or suggests the improved combination of the subject matter according to the present invention.

SUMMARY OF THE INVENTION

The present invention provides a unique package for non-round glass bottles although it may be used as well for plastic bottles of the same configuration. The non-round bottles are aligned in at least two rows within the package, there being glass-to-glass contact only between bottles within a row and not between rows. The main body portion of each bottle is of substantially elliptical horizontal cross-sectional configuration tapering upwardly and inwardly in at least one plane to form a neck. Each bottle is provided with parallel, substantially flat surfaces on opposed side across the shorter dimension of the main body portion, the flat surfaces mating with like flat surfaces of other such bottles for the only glass-to-glass contact in the package. Preferably, the flat surfaces are of a generally elongate shape on the lowermost portion of the bottles.

A tray member receives and supports each of the bottles. A divider member is provided between the rows of the bottles, the divider having a cushion means at the uppermost portion thereof for lateral support of the necks of the bottles. A film-like sheet envelops and holds tightly together the bottles, the tray member and the divider member to form a unified and substantially rigid package whereby material costs and usage are decreased considerably over the conventional, full partition, corrugated fiberboard shipping containers.

Advantages of the package of the present invention accrue in all phases of handling of the bottles. For example, in preparing the bottles to receive products such as salad dressing and the like, empty glass bottles may be received in bulk palletized form, or in reshipper trays. Once filled and assembled in package form according to the present invention, the tightly fitting bottles occupy smaller volume, may be stacked, and more packages of the bottles may be placed on a pallet than can conventionally packaged bottles. The plastic film around the bottles has an advantage over the conventional case because it will contain the product in the event breakage or damage occurs. The product will not contaminate adjoining and lower cases of a stackload of packages thereby decreasing damage claims. Also, pilferage may be reduced because any missing product can readily be detected in the package and is not hidden from view as in conventional shipping cases. Finally, the package provides ease of product display for retail stores by eliminating the need of case cutting and product removal from the case. Depending upon the size of the case package, it is possible to put the whole tray with contents, albeit minus film and divider, directly on a store shelf.

It is therefore, an object of the present invention to provide a package for glass and even breakable plastic bottles of a non-round configuration wherein a plurality of such bottles are aligned in rows within the package, each bottle having parallel and substantially flat surfaces on opposed sides that mate with like flat surfaces of other such bottles, a tray member for receiving and supporting the bottles, a divider member between rows of the bottles and having cushion means for lateral support, and a film-like member enveloping and holding tightly together the bottles, tray and divider member in a substantially rigid package.

A further object of the present invention is the provision of such a package wherein each of the non-round bottles each has a main body portion with a substantially elliptical horizontal cross-sectional configuration tapering upwardly and inwardly in at least one plane to form a neck, with flat surfaces on opposed sides of the shorter dimension or in the shorter direction of the main body portion of the bottle.

Still a further object of the present invention is the provision of such a type of package wherein the film-like member may be formed of a suitable film material such as polyethylene, polypropylene, polyvinylchloride or the like.

Yet another object of the present invention is the provision of such a package wherein one or more flat surfaces on each side of the bottles provide glass-to-glass contact with the lower or only contact preferably at the lowermost portions of the sidewalls of the bottles.

A still further object of the present invention is the provision of such a package wherein the tray, divider member and film-like material maintain the bottles erect and tightly together so as to permit stable stacking of a plurality of such packages with efficient space utilization.

Other and further objects, features and advantages will be apparent from the following description of the presently preferred embodiment of the invention, given for the purpose of disclosure and taken in conjunction with the accompanying drawings.

DESCRIPTION OF THE DRAWINGS

In the drawings forming a part of the disclosure, herein.

DESCRIPTION OF THE PREFERRED EMBODIMENT

Figure 1:
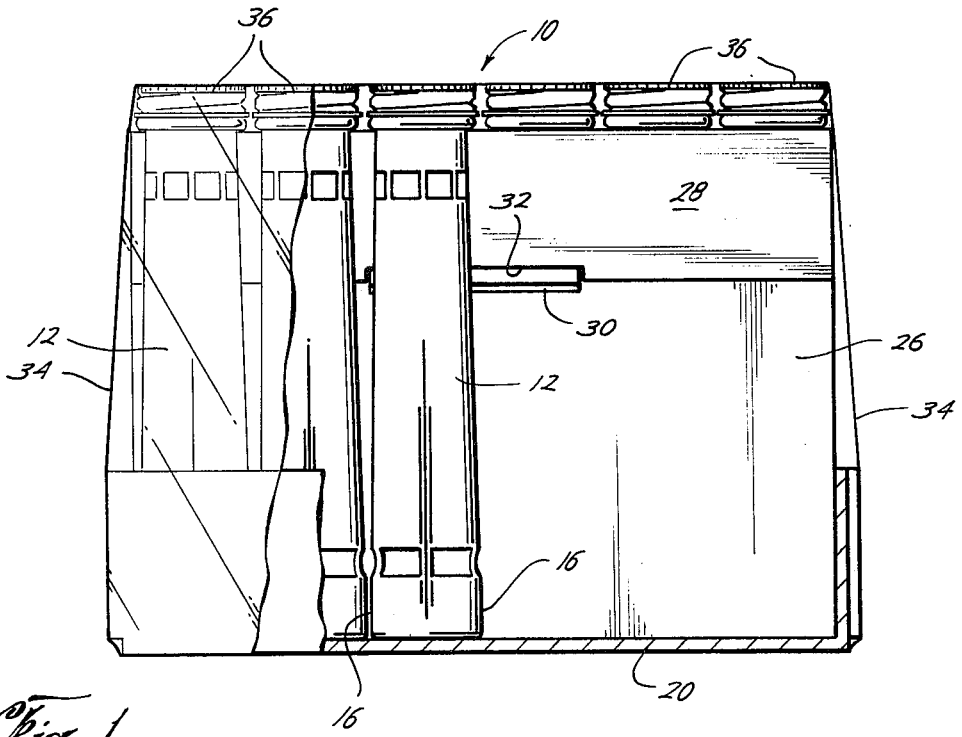
FIG. 1 is a side elevation view of the package of the present invention, partly in cross-section and partly cut away.
Figure 2:
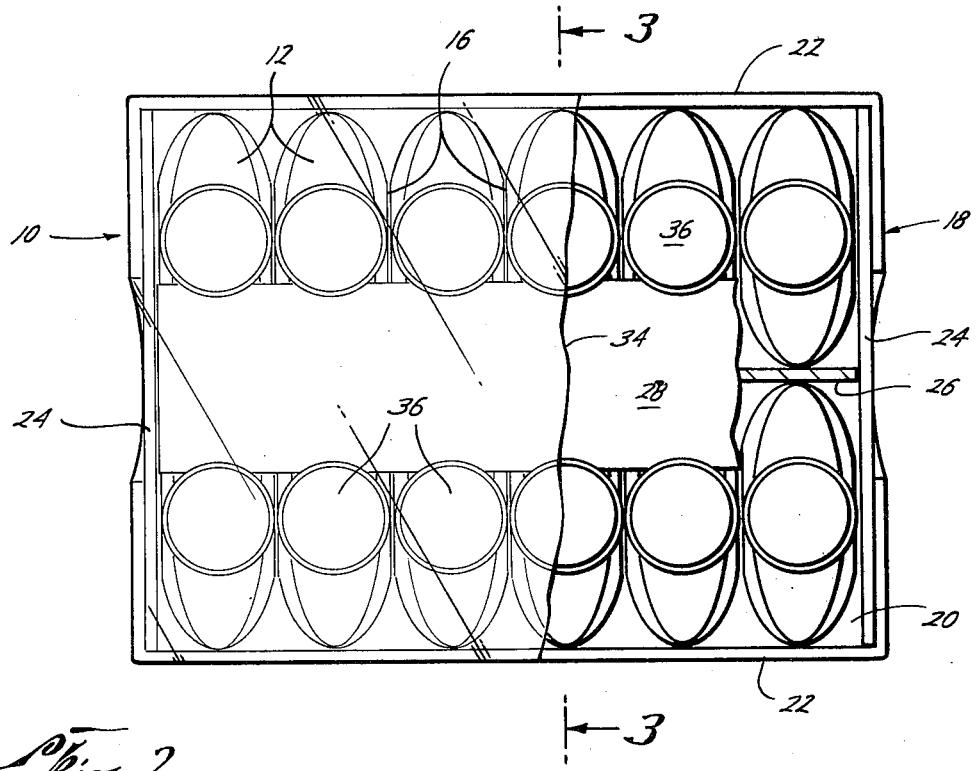
FIG. 2 is a plan view of the package of the present invention, partly in cross-section and partly cut away.
Figure 3:
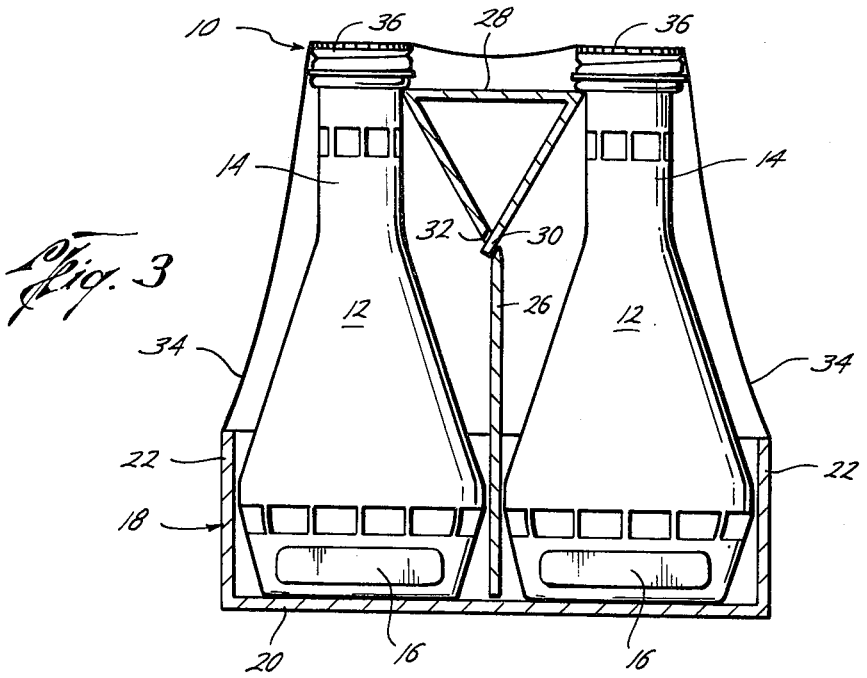
FIG. 3 is an end elevation view of the package of the present invention in cross-section taken along the line 3—3 of FIG. 2.
Figure 4:
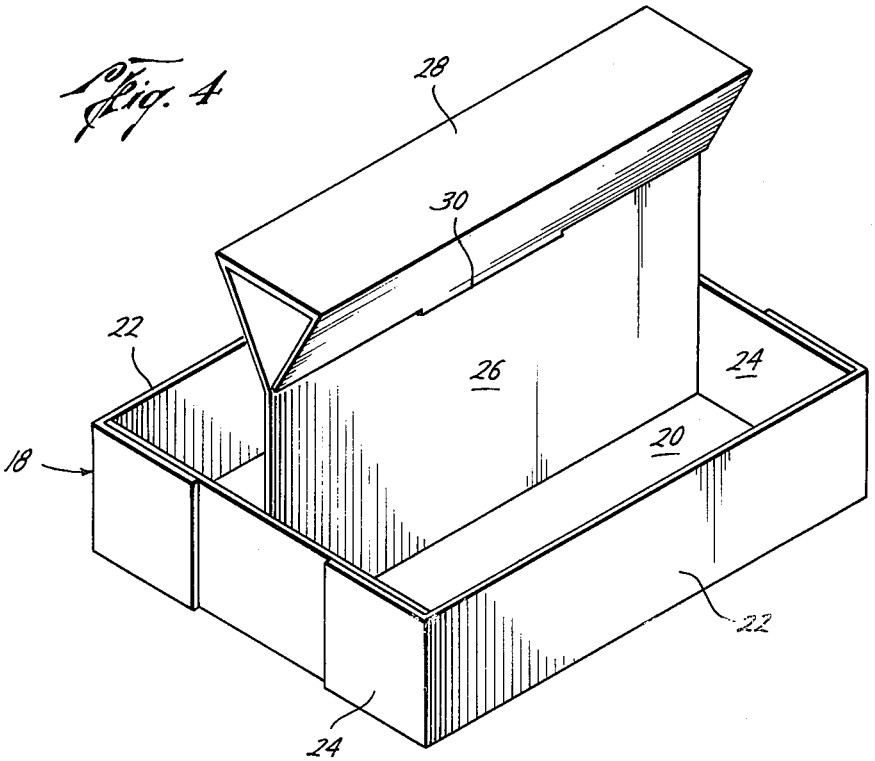
FIG. 4 is a perspective view of the tray and divider member of the present invention.

Referring now to the drawings, and particularly FIGS. 1–3, the package according to the present invention is represented generally by the reference numeral 10. The bottles 12 are of a non-round shape and are aligned in at least two rows as shown in the drawings. Each bottle has a main body portion of substantially elliptical horizontal cross-sectional configuration (FIG. 2), tapering upwardly and inwardly in at least one plane to form a neck 14 (FIG. 3). Each bottle is provided with parallel, substantially flat surfaces 16 of a generally elongate shape on the lowermost portion of each of opposed sides of the main body portion of the bottle. The flat surfaces 16 are on the sides of each bottle transverse to the shortest axis across the horizontal cross section. Thus, the flat surfaces 16 mate with like flat surfaces of the other bottles to provide glass-to-glass contact between bottles within a row. While only one such flat surface is shown on each side of the bottles in the drawings in the preferred embodiment, a second such surface spaced apart from the first flat surface may be added to each opposed side of the bottles if desired.

A tray member 18 receives and supports each of the bottles 12. The tray may be formed of corrugated fiberboard or other suitable material, and is constructed so as to have a bottom portion 20 and an attached pair of sidewalls 22 and a pair of endwalls 24. The bottom and walls of the tray 18, of course, can be joined in any number of ways as is well known in the art.

A divider member 26 is provided to prevent contact of bottles between rows thereof. The divider 26 may be formed integrally of or attached to the tray 18 or may be separate. The divider member 26 is provided with cushion means at the uppermost portion thereof for lateral support of the necks of the bottles. Thus, the divider may be folded into a triangular configuration as is shown in the drawings to form a wedge 28 or may be formed into circular or square or still other configurations if desired. The wedge 28 may be held in position by forming a tab 30 that engages a slot 32. As best seen in FIG. 3, the triangular wedge 28 engages the neck of each bottle to prevent contact of bottles between rows, to maintain the bottles upright, and to provide lateral support for each bottle.

Once the bottles 12 are placed in the tray 18 with the divider member 26 in position, a film-like material 34 is placed around the entire assemblage to envelop and hold tightly together the bottles 12, the tray 18 and the divider member 26 in a substantially rigid package.

Any conventional process for placing film around the bottles and tray may be used as, for example, the techniques and methods for heat shrinking of plastic film disclosed in any of U.S. Pat. Nos. 3,331;503; 3,347,365, Re. 27,212, or 3,746,160. Any suitable heat-shrinkable film material may be used such as polyvinylchloride, polyethylene or polypropylene or other like materials. Alternatively, elastic film may be used by enveloping the tray and bottles with one or more wraps of elastic plastic film and heat sealing or tack sealing the end of the film to the package to hold the bottles tightly together. An example of elastic plastic film for this purpose is extruded low density polyethylene with stretch capability on the order of 25 percent.

Preferably, the tray 18 is formed of corrugated fiberboard that tightly fits about and encases the lower portions of the bottles 12 with the sidewalls 22 and 24 extending upward at least just above the greatest sidewall dimensions of the bottles 12. It is important that the tray 18 be sized and constructed so as to keep the bottles tightly together in coaction with the plastic film wrap 34. Also important is glass-to-glass contact between bottles only at the flat surfaces 16 of each bottle. If contact between bottles is required other than at the flat surfaces thereof, it may be between the closures or caps 36 of each bottle.

The divider 26 and associated cushion 28 may be constructed of a material such as corrugated fiberboard to provide adequate cushioning between rows of bottles and to prevent movement of rows of bottles toward each other.

Thus, it may be seen that the package of the present invention is a vast improvement over prior art packages. Glass bottles may be thus packaged as have cans and other non-fragile containers for many years. The resulting package requires less material, less space, may be stacked and palletized, will contain spilled products in the event that damage occurs, may reduce pilferage, and may be displayed easily as compared with conventional crates or boxes in which bottles are normally packaged.

The present invention, therefore, is well adapted to carry out the objects and attain the ends and advantages mentioned, as well as others inherent therein. While presently preferred embodiments of the invention have been given for the purpose of disclosure, numerous changes in the details of construction, the combination, shape, size and arrangement of parts may be resorted to without departing from the spirit and scope of the invention.

What is claimed is:

1. A package for non-round bottles, comprising, a. a plurality of non-round glass bottles aligned in at least two rows, each bottle i. having a substantially elliptical horizontal cross-sectional configuration main body portion tapering upwardly and inward in at least one plane to form a neck, and ii. having a substantially flat surface on each of opposed sides of the shorter dimensional horizontal cross-sectional configuration of the main body portion (i), said flat surfaces being parallel so as to mate in glass-to-glass contact with like flat surfaces of other such bottles, b. a tray member for receiving and tightly supporting the bottles (a), c. a divider member between rows of the bottles (a) and having cushion means at the uppermost portion thereof for lateral support of and maintaining separation of the necks of said bottles, and d. a film-like member enveloping and holding tightly together the bottles (a), the tray member (b), and the divider member (c) in a substantially rigid package.

2. The package of claim 1 wherein the bottles (a) are aligned in two rows.

3. The package of claim 1 wherein the flat surfaces (a) (ii) are of generally elongate shape and are at the lowermost portion of the sidewalls of each bottle (a).

4. The package of claim 1 wherein the film-like member (d) is formed of film material selected from the group consisting of polyethylene, polypropylene, polyvinylchloride and other similar materials.

5. The package of claim 1 wherein the bottles (a) are aligned in two rows and wherein the flat surfaces (a) (ii) of each bottle are of generally elongate shape and are at the lowermost portion of the sidewalls of each bottle.

6. The package of claim 5 wherein the film-like member (d) is formed of heat-shrinkable film material selected from the group consisting of polyethylene, polypropylene, polyvinylchloride and other similar materials.

7. A package for non-round glass bottles comprising, a. a plurality of non-round bottles aligned in at least two rows, each bottle i. having a substantially elliptical horizontal cross-sectional configuration main body portion tapering upwardly and inward in at least one plane to form a neck, and ii. having a substantially flat surface of a general elongate shape on the lowermost portion of each of opposed sides transverse to the shortest axis across the horizontal cross-section of the main body portion, said flat surfaces being parallel so as to mate in glass-to-glass contact with like flat surfaces of other such bottles, b. a tray member for receiving and tightly supporting the bottles (a), c. a divider member between rows of the bottles (a), and having cushion means at the uppermost portion thereof for lateral support of and maintaining separation of the necks of said bottles, and d. a plastic film enveloping and holding tightly the bottles (a), the tray member (b) and the divider member (c) in a substantially rigid package.

8. The package of claim 7 wherein the bottles are aligned in two rows.

9. The package of claim 7 wherein the plastic film (d) is formed of heat-shrinkable film material selected from the group consisting of polyethylene, polypropylene, polyvinylchloride and other similar materials.

* * * * *